US007367388B2

(12) United States Patent
Yagisawa

(10) Patent No.: US 7,367,388 B2
(45) Date of Patent: May 6, 2008

(54) EVAPORATOR FOR CARBON DIOXIDE AIR-CONDITIONER

(75) Inventor: Kenji Yagisawa, Sano (JP)

(73) Assignee: Calsonic Kansei Corporation, Tokyo (JP)

( * ) Notice: Subject to any disclaimer, the term of this patent is extended or adjusted under 35 U.S.C. 154(b) by 78 days.

(21) Appl. No.: 11/350,128

(22) Filed: Feb. 9, 2006

(65) Prior Publication Data

US 2006/0179876 A1 Aug. 17, 2006

(30) Foreign Application Priority Data

Feb. 15, 2005 (JP) ..... 2005-038086

(51) Int. Cl.
*F28F 9/02* (2006.01)

(52) U.S. Cl. ..... 165/174; 165/150; 165/913

(58) Field of Classification Search ..... 165/150, 165/174, 175, 913; 62/515
See application file for complete search history.

(56) References Cited

U.S. PATENT DOCUMENTS

| | | | | |
|---|---|---|---|---|
| 5,186,249 | A | 2/1993 | Bhatti et al. | |
| 5,906,237 | A | 5/1999 | Aikawa | |
| 5,941,303 | A * | 8/1999 | Gowan et al. | 165/176 |
| 6,340,055 | B1 | 1/2002 | Yamauchi et al. | |
| 6,430,945 | B1 * | 8/2002 | Haussmann | 165/175 |

FOREIGN PATENT DOCUMENTS

| | | | | |
|---|---|---|---|---|
| FR | 2 665 757 | A1 | 2/1992 | |
| JP | 63-271099 | * | 11/1988 | 165/913 |
| JP | 3-247992 | A | 11/1991 | |
| JP | 2003-028539 | A | 1/2003 | |

* cited by examiner

*Primary Examiner*—Teresa J. Walberg
(74) *Attorney, Agent, or Firm*—Foley & Lardner LLP

(57) ABSTRACT

A core includes heat-exchange tubes and radiation fins are alternately stacked on each other. The heat-exchange tubes define refrigerant passages. A header tank is connected to the heat-exchange tubes. A partition separates the header tank into first and second header chambers to turn a refrigerant. The partition defines a communication hole allowing the first and second header chambers to communicate with each other.

5 Claims, 10 Drawing Sheets

EVAPORATOR FOR CARBON DIOXIDE AIR-CONDITIONER

CROSS-REFERENCE TO RELATED APPLICATIONS

This application is based upon and claims the benefit of priority from Japanese Patent Application No. 2005-038086 filed on Feb. 15, 2005; the entire contents of which are incorporated herein by reference.

BACKGROUND OF THE INVENTION

The invention relates to an evaporator for a carbon dioxide air-conditioner for cooling using carbon dioxide as a refrigerant.

There have been proposed related heat exchangers and refrigeration cycle apparatuses (e.g., Japanese Patent Application Laid-open No. 2003-28539 (paragraphs 0035 to 0040, FIG. 1)). In the related art, an area of a refrigerant passage closer to a refrigerant outlet of an evaporator tube is set greater than an area of the refrigerant passage closer to a refrigerant inlet.

According to this setting, the speed of a refrigerant in the refrigerant passage closer to the refrigerant outlet is reduced, and a liquid phase refrigerant covering the refrigerant passage is prevented from being carried by a gas phase refrigerant. This suppresses so-called dryout in the refrigerant passage closer to the refrigerant outlet, and enhances the heat exchange efficiency.

The invention is directed to provide an evaporator for a carbon dioxide air-conditioner preventing lubricant oil separated from a refrigerant from accumulating in a header tank.

SUMMARY OF THE INVENTION

An aspect of the invention provides an evaporator (30, 40, 50, 60, 70, 80) for a carbon dioxide air-conditioner. The evaporator includes a core (2) including heat-exchange tubes (6) and radiation fins (7) alternately stacked on each other, the heat-exchange tubes defining refrigerant passages. The evaporator includes a header tank (3, 4) connected to the heat-exchange tubes (6). The evaporator includes a partition (13, 18) separating the header tank (3,4) into first and second header chambers (14 to 17, 19 to 21, 23) to turn a refrigerant. The partition defines a communication hole (31, 41, 53, 61) allowing the first and second header chambers (15, 16, 20, 21) to communicate with each other.

The header tank (3, 4) connects to an outlet pipe (11) having the refrigerant to flow out therefrom. The first and second header chambers are separate from a header chamber (17, 23) connected to the outlet pipe.

The communication hole (31, 41, 51, 53, 61, 63) is positioned at the vertically lowermost portion of the partition (13, 18).

The heat-exchange tubes have ends projecting into the header tank (3). At least one of the ends has a communication portion (42, 43, 52, 62) extending therethrough.

The heat-exchange tubes (6) are divided into a set of refrigerant circulation passes (P1 to P6). The set of refrigerant circulation passes has a first pass (P6) on a refrigerant output side, a second pass (P5) upstream by one from the first pass, and a third pass (P4) upstream by two from the first pass. Each of the first pass and the second pass is set smaller in refrigerant passage area than the third pass.

According to the invention, a refrigerant flows into one of the first and second header chambers of the header tank to turn to flow out. A lubricant is separated from the refrigerant to flow in the one of the first and second header chambers. The lubricant flows out to the other of the first and second header chambers through the communication hole of the partition together with a portion of the refrigerant. This invention prevents the lubricant from accumulating in the header tank. This invention reduces formation of an oil film on the walls in the heat-exchange tubes by a large amount of accumulated oil to flow into the narrowed refrigerant passages in the heat-exchange tubes. This operation enhances the heat-exchange performance and allows a lot of lubricant to return to the compressor from the evaporator, thus reducing an amount of lubricant to be included in the compressor.

BRIEF DESCRIPTION OF THE ACCOMPANYING DRAWINGS

DETAILED DESCRIPTION OF THE PREFERRED EMBODIMENTS

Figure 14:
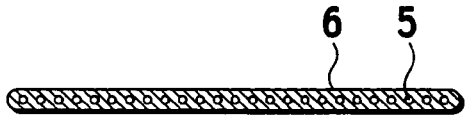
FIG. 14 is an enlarged transverse sectional view of a flat tube provided in the evaporator illustrated in FIG. 13.

The aforementioned art will be described with reference to FIGS. 13 to 18. An evaporator 1 mainly includes a core 2 and a pair of upper and lower header tanks 3 and 4. The core 2 includes vertically extending flat tubes 6 and radiation fins 7. The tubes 6 and the fins 7 are stacked on each other alternately. With reference to FIG. 14, the tubes 6 are provided therein with refrigerant passages 5 extending in the longitudinal direction of the flat tubes 6. The refrigerant passages 5 are disposed in parallel to one another at predetermined intervals. In the header tanks 3 and 4, refrigerant passages 8 extend in the longitudinal direction (direction perpendicular to the image of FIG. 15) and have a refrigerant to flow therethrough. Neighboring refrigerant passages 8 are separated by a support 9. Both ends of the upper header tank 3 are connected to an inlet pipe 10 and an outlet pipe 11, respectively. The upper header tank 3 has both ends having outer sides mounted on packings 12.

Figure 15:
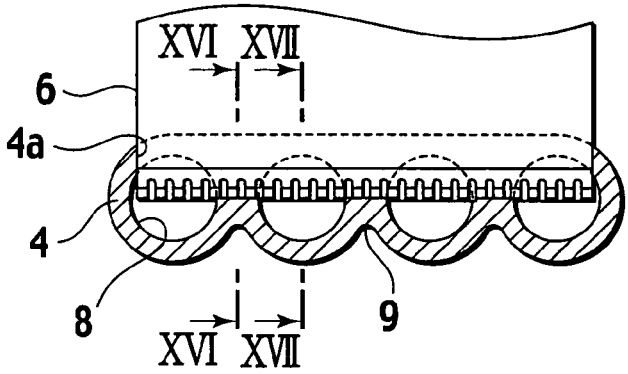
FIG. 15 is an enlarged vertical sectional view of a connecting portion between a lower header tank and a flat tube lower end provided in the evaporator illustrated in FIG. 13.
Figure 16:
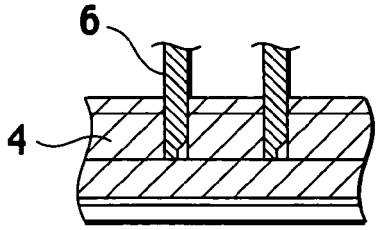
FIG. 16 is a vertical sectional view of the connecting portion illustrated in FIG. 15 taken along XVI-XVI.
Figure 17:
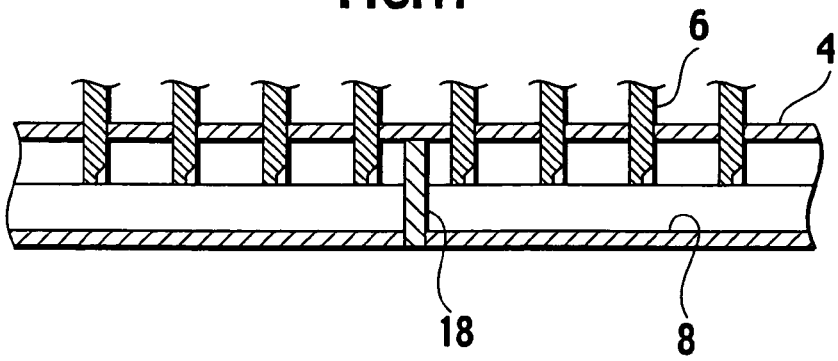
FIG. 17 is a vertical sectional view of the connecting portion illustrated in FIG. 15 taken along XVII-XVII.

With reference to FIGS. 15 to 17, the flat tubes 6 have lower ends inserted into slits 4*a* of the lower header tank 4 and coupled to each other, for example, by brazing. In this assembly, the refrigerant passage 5 of each flat tube 6 and the refrigerant passage 8 of the header tank 4 communicate with each other. A refrigerant flows between the flat tube 6 and the lower header tank 4. Similarly, the upper end of the flat tube 6 is coupled to the upper header tank 3. A refrigerant flows between the flat tube 6 and the upper header tank 3.

Figure 18:
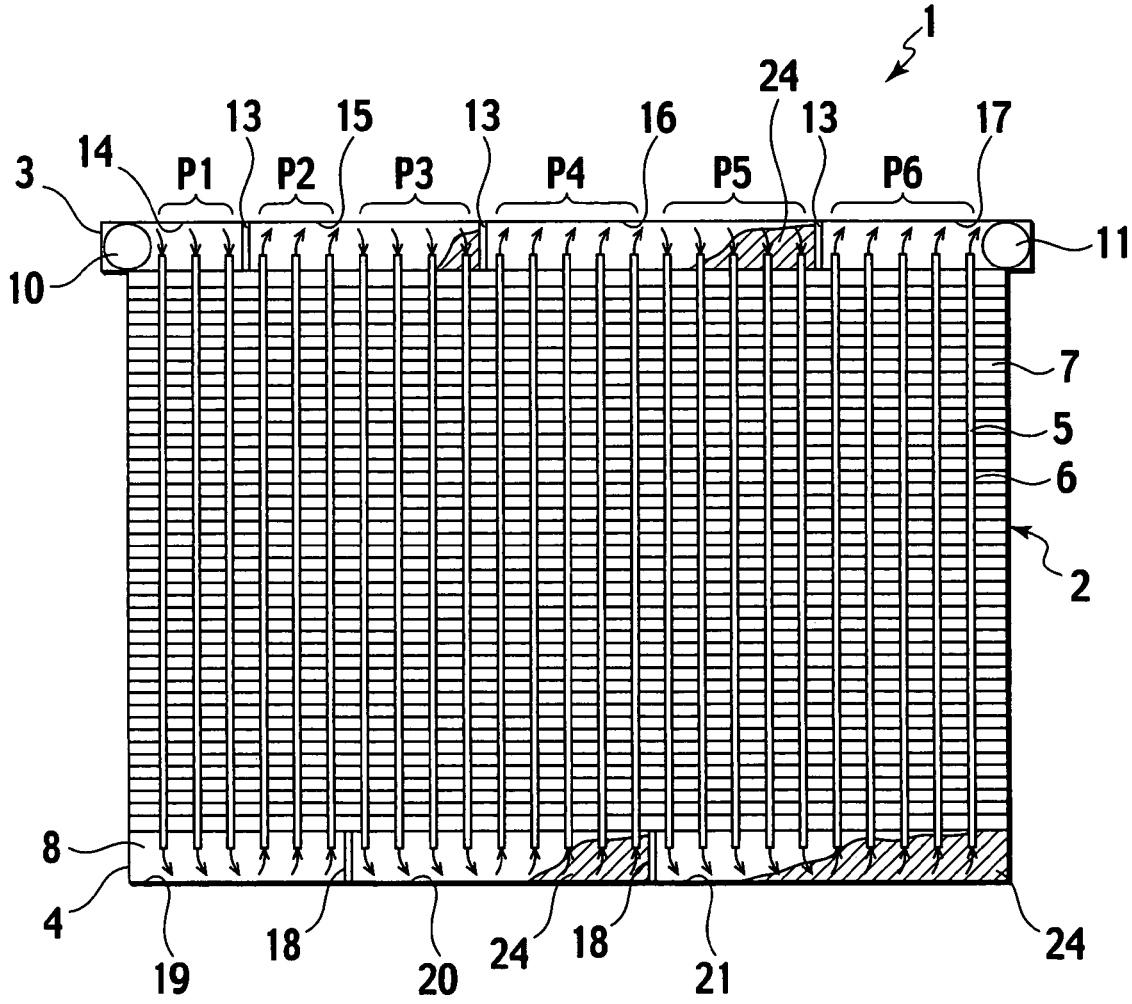
FIG. 18 is a vertical sectional view of an internal structure of the evaporator illustrated in FIG. 13.

With reference to FIG. 18, the continuous flat tubes 6 constitute six sets of refrigerant circulation passes P1 to P6. For example, each of the inlet side first pass P1 and the second pass P2 includes three flat tubes 6. The third pass P3 includes four flat tubes 6. Each of the fourth pass P4, the fifth pass P5, and refrigerant outlet side sixth pass P6 includes five flat tubes 6. The upper header tank 3 includes three divide plates 13 as partitions that turn (change of direction) a refrigerant. These divide plates 13 separate the first pass P1 and the second pass P2 from each other, the third pass P3 and the fourth pass P4 from each other, and the fifth pass P5 and the sixth pass P6 from each other. By dividing the passes in this manner, a first header chamber 14, a second header chamber 15, a third header chamber 16, and a fourth header chamber 17 are formed in the upper header tank 3. Similarly, the lower header tank 4 also has two divide plates 18 that turn the refrigerant. The divide plates 18 separate the second pass P2 and the third pass P3 from each other, and the fourth pass P4 and the fifth pass P5 from each other. These separations form a first header chamber 19, a second header chamber 20, and a third header chamber 21 in the lower header tank 4.

As illustrated in FIG. 18, in the evaporator 1, a refrigerant flows into the first header chamber 14 in the upper header tank 3 through the inlet pipe 10. The refrigerant then flows down through the flat tube 6 of the first pass P1, flows into the first header chamber 19 of the lower header tank 4 and turns upward. The refrigerant flows upward in the flat tube 6 of the second pass P2, flows into the second header chamber 15 of the upper header tank 3 and turns downward. The refrigerant flows downward in the flat tube 6 of the third pass P3, flows into the second header chamber 20 of the lower header tank 4 and turns upward. The refrigerant flows upward in the flat tube 6 of the fourth pass P4, flows into the third header chamber 16 of the upper header tank 3 and turns downward. The refrigerant flows downward in the flat tube 6 of the fifth pass P5, flows into the third header chamber 21 of the lower header tank 4 and turns upward. The refrigerant flows upward in the flat tube 6 of the sixth pass P6, flows into the fourth header chamber 17 of the upper header tank 3, flows out through the outlet pipe 11, and returns to a compressor (nor illustrated).

Figure 19:
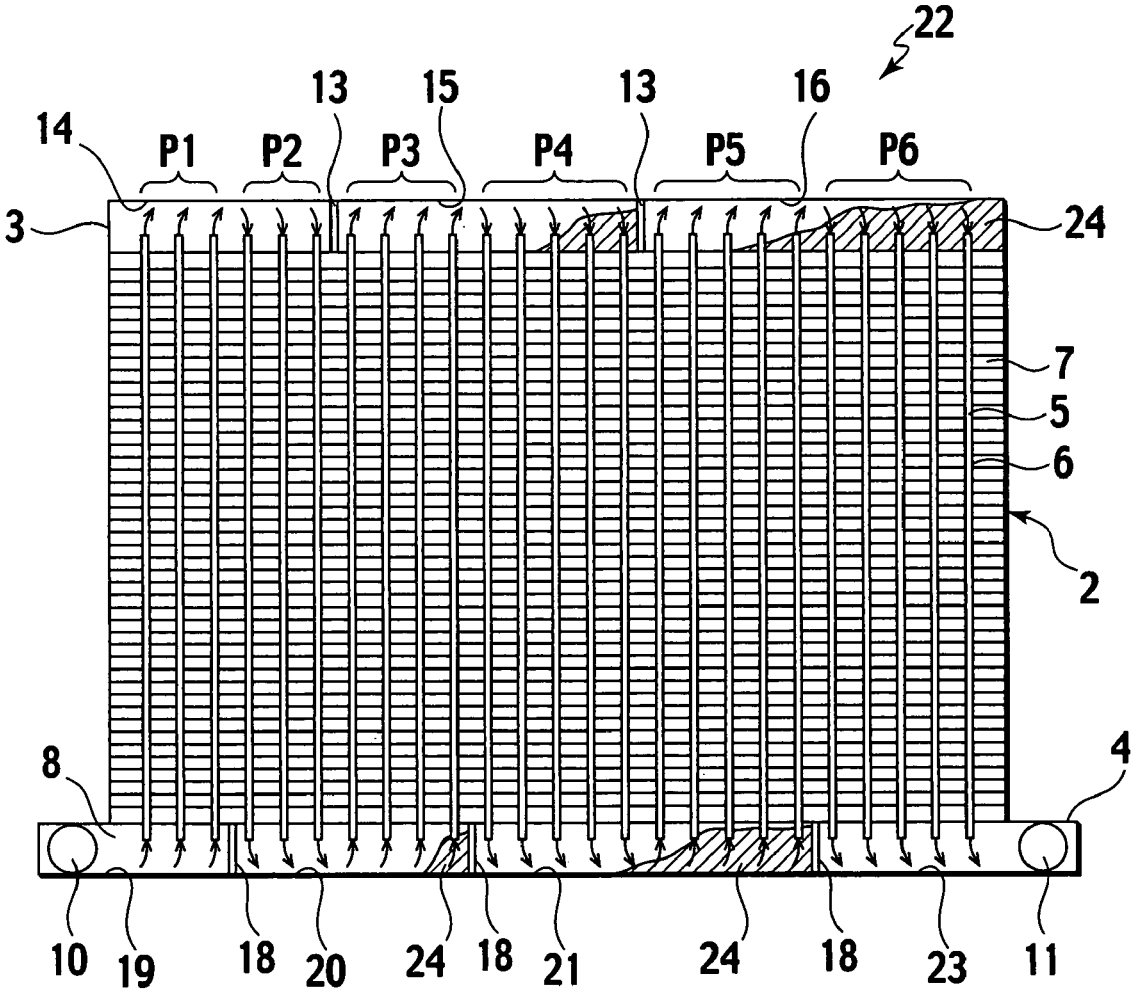
FIG. 19 is a vertical sectional view of an internal structure of the evaporator having an outlet pipe and an inlet pipe connected to the lower header tank.

With reference to FIG. 19, in another evaporator 22, the lower header tank 4, the inlet pipe 10, and the outlet pipe 11 are connected to one another. The lower header tank 4 includes three divide plates 18 that turn the refrigerant. The lower header tank 4 includes the first header chamber 19, the second header chamber 20, the third header chamber 21, and the fourth header chamber 23. The upper header tank 3 includes two divide plates that turn the refrigerant. The upper header tank 3 includes the first header chamber 14, the second header chamber 15, and the third header chamber 16.

With reference to FIGS. 18 and 19, according to the evaporator 1 and 22, while the refrigerant flows in the evaporator 1, lubricant oil 24 included in the refrigerant is separated and accumulated in a downstream side (right side in FIG. 18) of the second header chamber 15 and the third header chamber 16 of the upper header tank 3. The refrigerant is accumulated in the downstream side (right side in FIG. 18) of the second header chamber 20 and the third header chamber 21, and the oil 24 does not return to the compressor smoothly. Thus, a large amount of accumulated oil 24 enters the thin refrigerant passage 5 in the flat tube 6, forms an oil mm and hinders thermal transmission. This hindrance also deteriorates heat exchange performance, and this generates the need for additionally charging the same amount of oil as the accumulated oil 24.

An evaporator for a carbon dioxide air-conditioner according to respective embodiments will be described below with reference to the drawings.

First Embodiment

Figure 1:
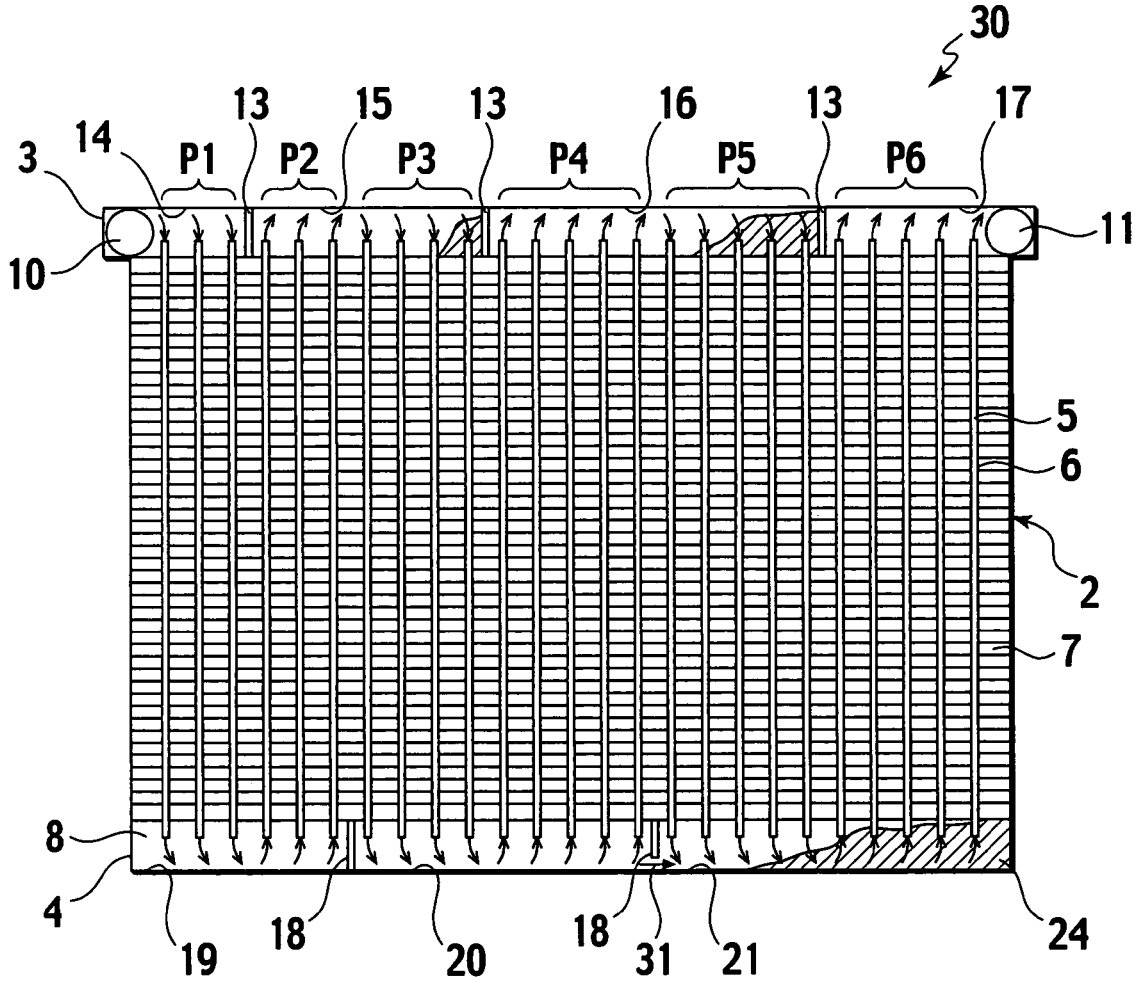
FIG. 1 is a vertical sectional view of an evaporator for a carbon dioxide air-conditioner according to a first embodiment.

With reference to FIG. 1, the first embodiment is characterized in that an evaporator 30 has a communication hole 31 as compared with the evaporator 1 illustrated in FIGS. 13 to 18. The communication hole 31 is formed in divide plates 18 in a lower header tank 4 that is not connected to an inlet pipe 10 and an outlet pipe 11. The communication hole 31 allows neighboring second header chamber 20 and third header chamber 21 to communicate with each other.

Figure 2:
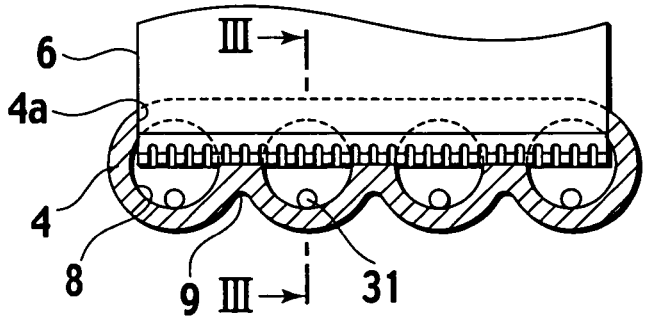
FIG. 2 is an enlarged vertical sectional view of a connecting portion between a lower header tank and a tube lower end illustrated in FIG. 1.
Figure 3:
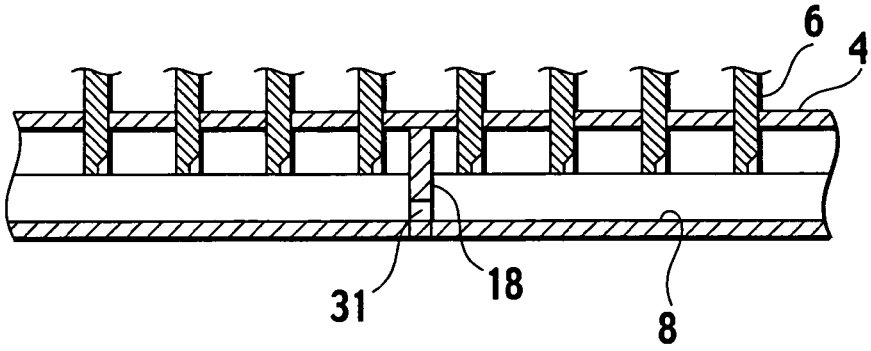
FIG. 3 is a vertical sectional view of the connecting portion taken along III-III in FIG. 2.

As illustrated in FIGS. 2 and 3, the circular communication hole 31 is positioned, for example, at the vertically lowermost position of the divide plate 18. The communication hole may be positioned at a vertically lower position of the divide plate 18.

While a refrigerant flows in the evaporator 30, the refrigerant flows downward in the flat tube 6 of the third pass P3, and flows into the second header chamber 20 of the lower header tank 4. The refrigerant turns upward, and flows upward in the flat tube 6 of the fourth pass P4. At the same time, the refrigerant turns upward, and flows upward in the flat tube 6 of the fourth pass P4. At the same time, the lubricant oil 24 separated from the refrigerant flows into a downstream side (right side in FIG. 1) of the second header chamber 20. The oil 24 then flows out from the second header chamber 20 through the communication hole 31 of the divide plate 18 together with a portion of the refrigerant. At this time, the specific gravity of the oil 24 is relatively large and the oil 24 flows downward, and the oil 24 is facilitated to pass through the communication hole 31 provided at the vertically lowermost position of the divide plate 18. Next, the lubricant oil 24 is accumulated in the downstream side (right side in FIG. 1) of the third header chamber 21.

According to the first embodiment, the lubricant oil 24 separated from the refrigerant is prevented from accumulating in the lower header tank 4 that is not connected to the inlet pipe 10 and the outlet pipe 11.

Second Embodiment

Figure 4:
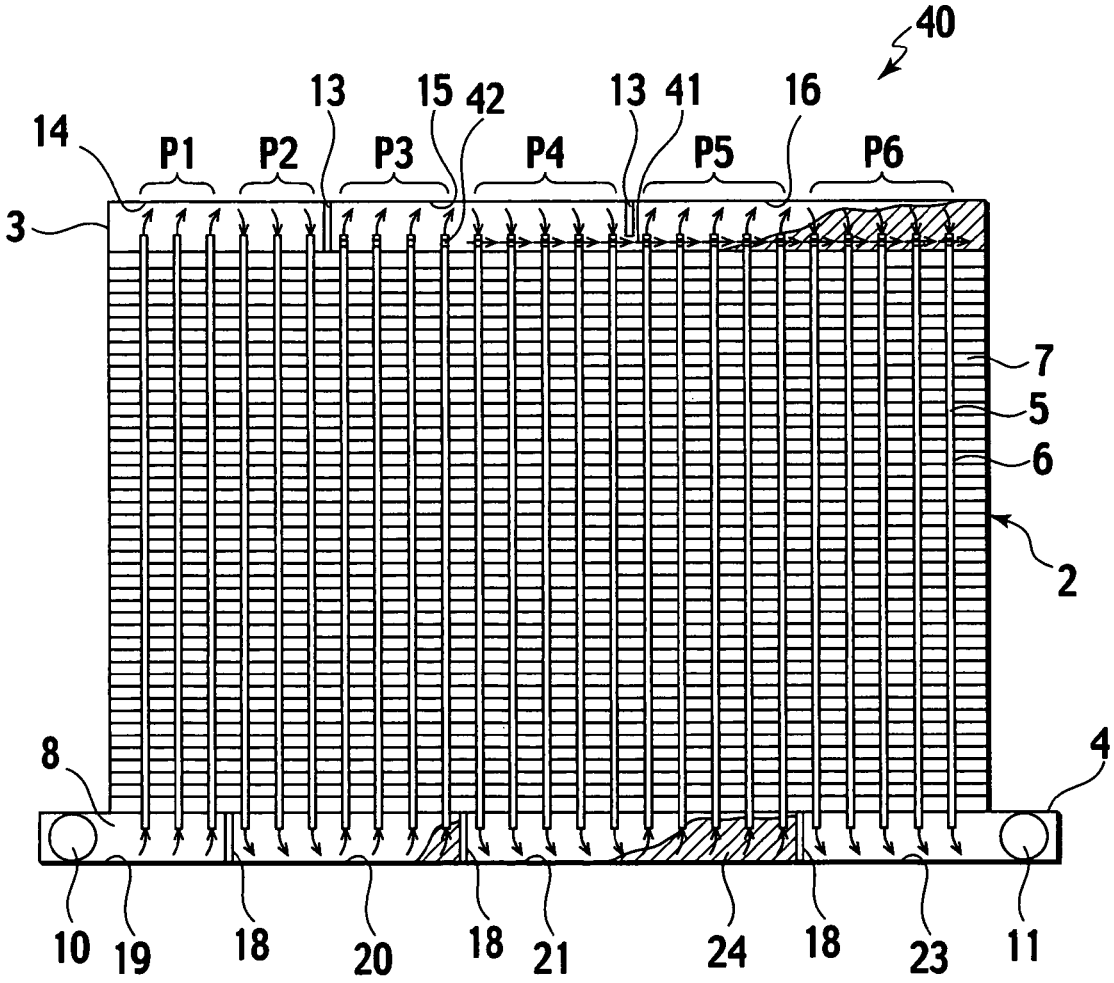
FIG. 4 is a vertical sectional view of an evaporator for a carbon dioxide air-conditioner according to a second embodiment.

With reference to FIG. 4, the second embodiment is characterized in that an evaporator 40 includes communication holes 41 and 42, as compared with the evaporator 1 illustrated in FIG. 19. The communication hole 41 is formed in the divide plate 13 in the upper header tank 3 that is not connected to the inlet pipe 10 and the outlet pipe 11. The communication hole 41 allows the neighboring second header chamber 15 and third header chamber 16 to communicate with each other. The circular communication hole 42 is one example of a communicating portion that extends through the upper ends of the flat tubes 6 of the third pass P3, the fourth pass P4, the fifth pass P5 and the sixth pass P6.

Figure 5:
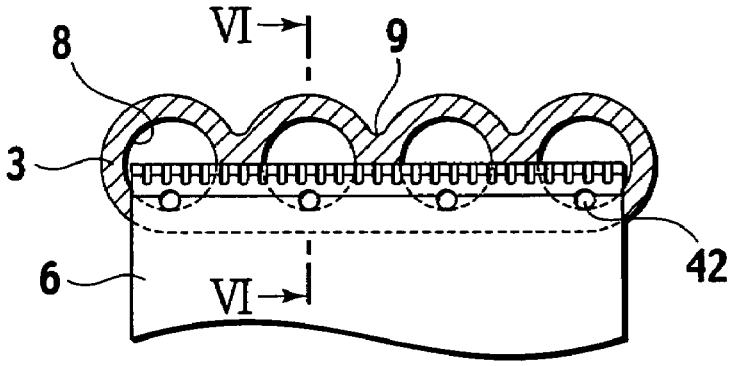
FIG. 5 is an enlarged vertical sectional view of a connecting portion between an upper header tank and a tube upper end illustrated in FIG. 4.
Figure 6:
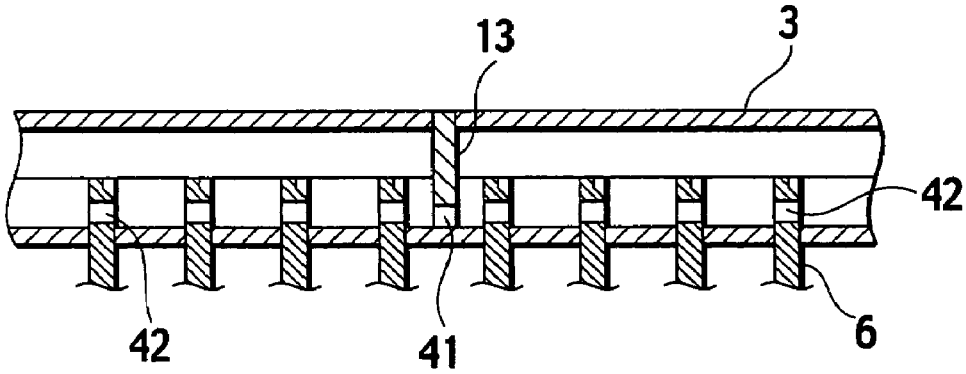
FIG. 6 is a vertical sectional view of the connecting portion taken along VI-VI in FIG. 5.

With reference to FIGS. 5 and 6, the communication hole 41 is positioned at the vertically lowermost position of the divide plate 13 that separates the second header chamber 15 and the third header chamber 16 from each other. The upper ends of the flat tubes 6 project into the upper header tank 3. The communication hole 42 is positioned at the vertically lowermost position of the projecting portions of the upper ends of the flat tubes 6 of the third pass P3, the fourth pass P4, the fifth pass P5, and the sixth pass P6. While a refrigerant flows in the evaporator 40, the refrigerant flows upward in the flat tube 6 of the third pass P3, and flows into the second header chamber 15 of the upper header tank 3. The refrigerant turns downward and flows downward in the flat tube 6 of the fourth pass P4. Similarly, the lubricant oil 24 separated from the refrigerant flows downward (right side in FIG. 4) through the communication hole 42 of the flat tube 6 in the second header chamber 15. The oil 24 then flows out from the second header chamber 15 through the communication hole 41 of the divide plate 13 together with a portion of the refrigerant. At this time, the oil 24 having relatively large specific gravity sinks and flows downward. The oil 24 is facilitated to pass through the communication hole 42 provided at the vertically lowermost position of the projecting portion of the flat tube 6 and through the communication hole 41 provided at the vertically lowermost position of the divide plate 18. Next, the lubricant oil 24 is accumulated in a downstream side (right side in FIG. 4) of the third header chamber 16.

The evaporator 40 of the second embodiment prevents the lubricant oil 24 separated from the refrigerant from accumulating in the upper header tank 3 that is not connected to the inlet pipe 10 and the outlet pipe 11.

Figure 7:
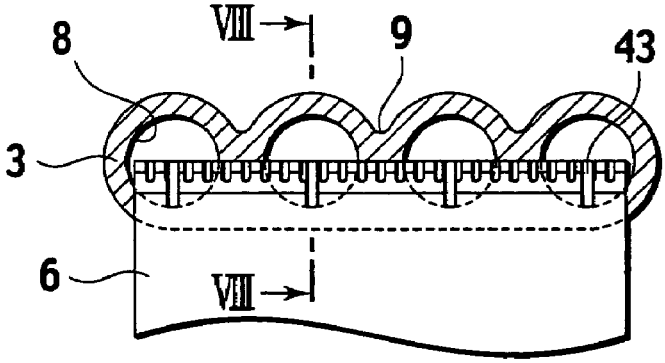
FIG. 7 is a vertical sectional view illustrating a modification of a communicating portion illustrated in FIG. 4.
Figure 8:
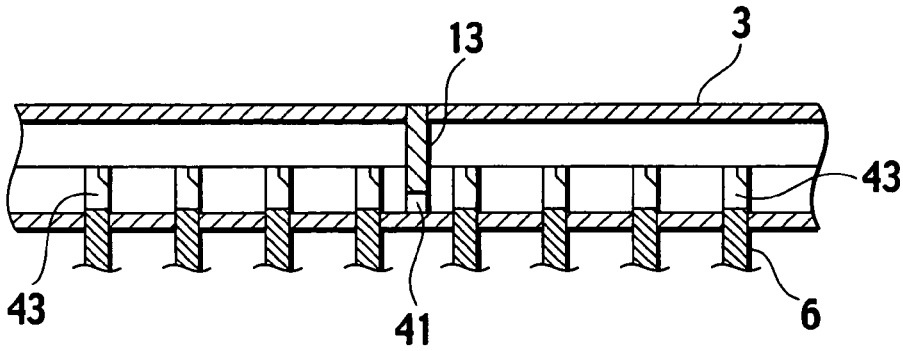
FIG. 8 is a vertical sectional view of the connecting portion of a flat tube in FIG. 7 taken along VIII-VIII.

The embodiment exemplifies a structure that the communication hole 42 extends through the upper ends of the flat tubes 6 of the third pass P3 and the fourth pass P4. This invention is not limited to this structure. As illustrated in FIGS. 7 and 8, the upper ends of the flat tubes 6 of the third pass P3 and the fourth pass P4 may have another communicating portion; for example, a slit 43 that extends in the vertical direction. The identical benefits are also achieved with this structure.

Third Embodiment

Figure 9:
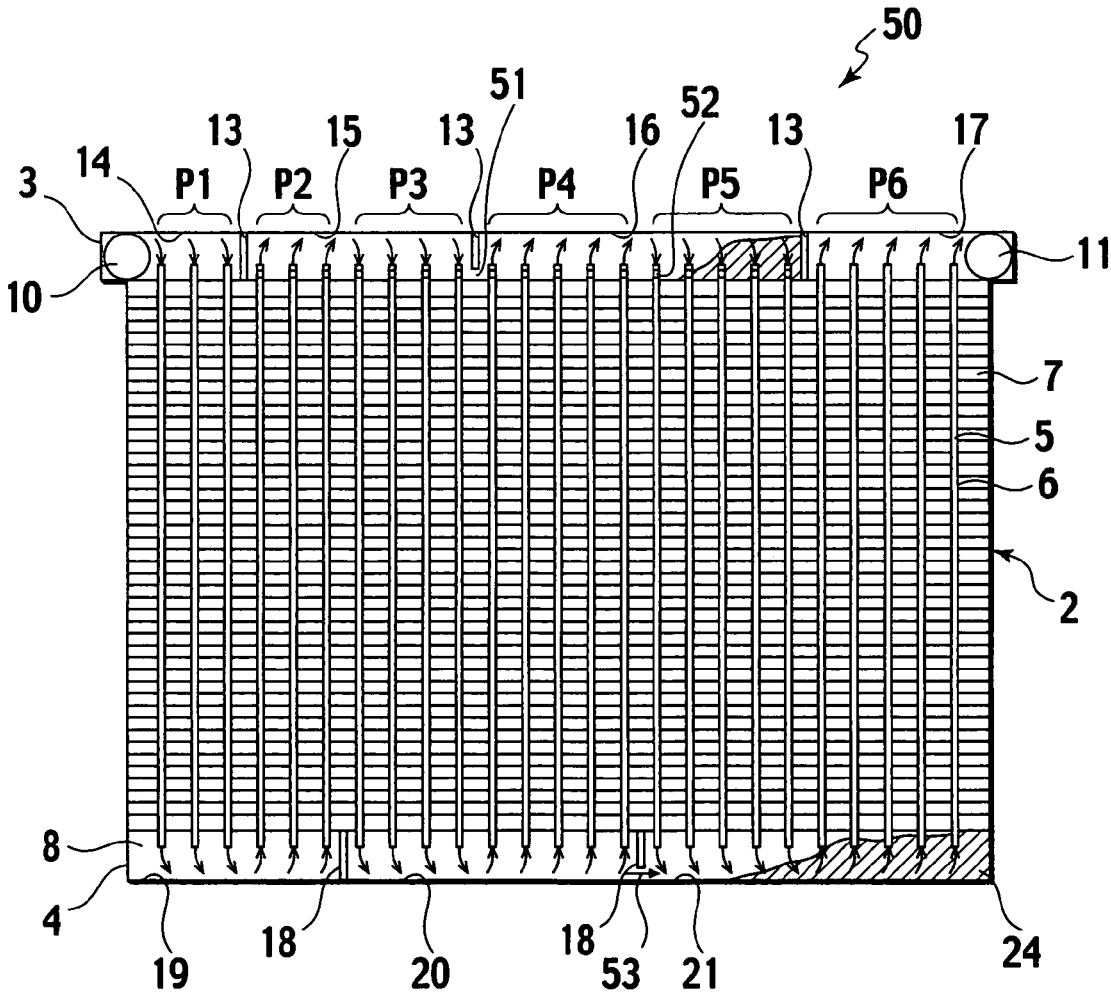
FIG. 9 is a vertical sectional view of an evaporator for a carbon dioxide air-conditioner according to a third embodiment.

With reference to FIG. 9, the third embodiment is characterized in that an evaporator 50 includes communication holes 51, 52, and 53 as compared with the evaporator 1 illustrated in FIGS. 13 to 18. The communication hole 51 is formed in the divide plate 13 in the upper header tank 3. The communication hole 51 allows the neighboring second header chamber 15 and third header chamber 16 to communicate with each other, the chambers 15 and 16 being different from the fourth header chamber 17 connected to the outlet pipe 11. The communication hole 52 extends through the upper ends of the flat tubes 6 of the second pass P2, the third pass P3, the fourth pass P4, and the fifth pass P5. The communication hole 53 allows the neighboring second header chamber 20 and third header chamber 21 to communicate with the divide plate 18 in the lower header tank 4. Both ends of the upper header tank 3 are connected to the inlet pipe 10 and the outlet pipe 11, respectively.

The communication hole 51 in the upper header tank 3 is positioned at the vertically lowermost position of the divide plate 13 that separates the second header chamber 15 and the third header chamber 16 from each other. The upper ends of the flat tubes 6 projects into the upper header tank 3. The communication hole 52 is positioned at the vertically lowermost position of the projecting portions of the upper ends of the flat tubes 6 of the second pass P2, the third pass P3, the fourth pass P4, and the fifth pass P5.

While the refrigerant flows in the evaporator 50, the refrigerant flows upward in the flat tube 6 of the second pass P2, and flows into the second header chamber 15 of the upper header tank 3. The refrigerant turns downward and flows downward in the flat tube 6 of the third pass P3. At this time, the lubricant oil 24 separated from the refrigerant flows into a downstream side (right side in FIG. 9) of the second header chamber 15. The oil 24 then flows into the third header chamber 16 through the communication hole 51 of the divide plate 13 together with a portion of the refrigerant. At this time, the oil 24 having relatively large specific gravity sinks and flows downward. The oil 24 is facilitated to pass through the communication hole 51 provided at the vertically lowermost position of the divide plate 13 and through the communication hole 52 provided at the vertically lowermost position of the projecting portion of the flat tube 6. Next, the lubricant oil 24 is accumulated in the downstream side of the third header chamber 16.

Similarly, also in the lower header tank 4, the lubricant oil 24 separated from the refrigerant flows in the downstream side of the second header chamber 20. The oil 24 then flows out from the second header chamber 20 through the communication hole 53 of the divide plate 18 together with a portion of the refrigerant. At this time, the oil 24 having relatively large specific gravity sinks to flow downward. The oil 24 is facilitated to pass through the communication hole 53 provided at the vertically lowermost position of the divide plate 18. Next, the lubricant oil 24 is accumulated in the downstream side of the third header chamber 21.

This embodiment prevents the lubricant oil 24 separated from the refrigerant from accumulating in the upper header tank 3 and the lower header tank 4.

Figure 10:
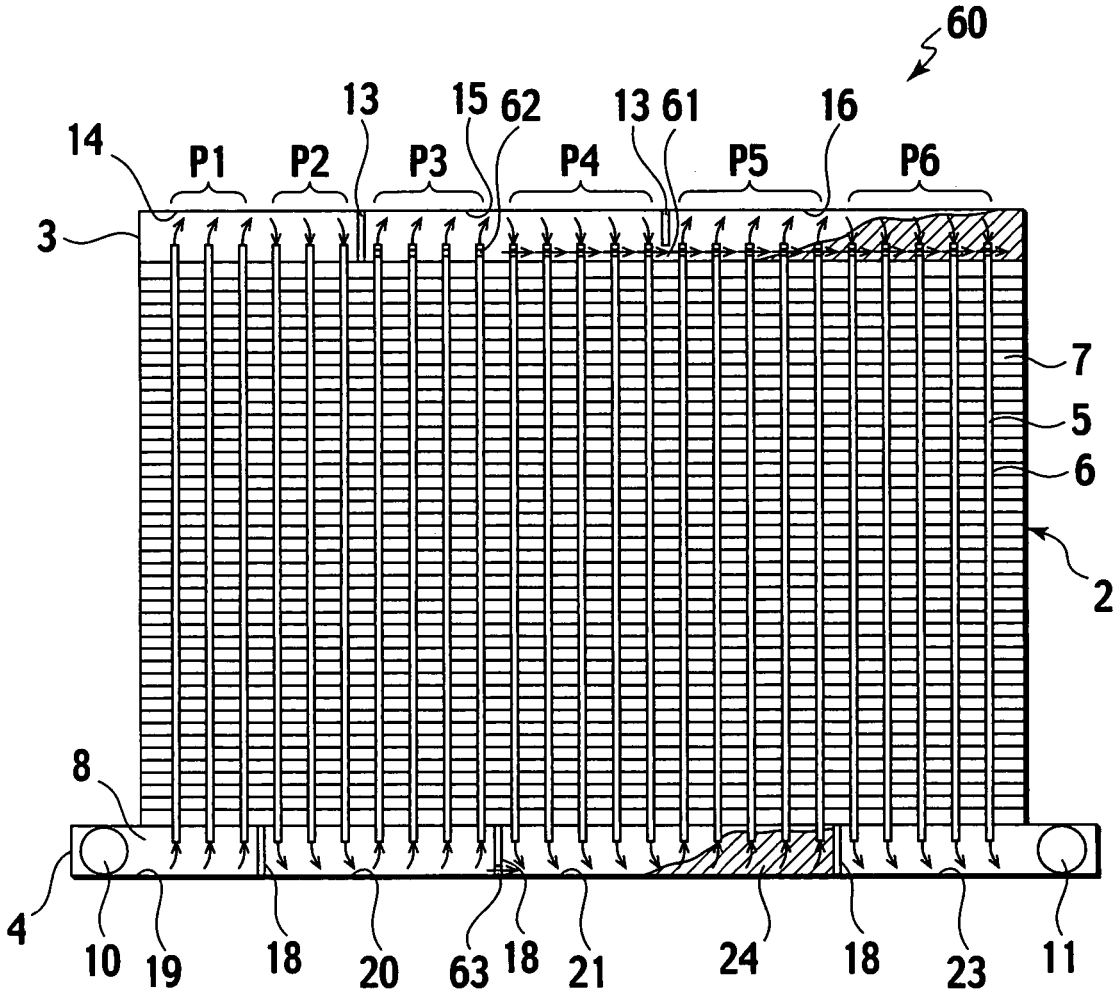
FIG. 10 is a vertical sectional view of a modification of the embodiment illustrated in FIG. 9.

This embodiment exemplifies a structure that the inlet pipe 10 and the outlet pipe 11 are connected to the both ends of the upper header tank 3. This invention is not limited to this structure. In this evaporator 60 as illustrated in FIG. 10, the inlet pipe 10 and the outlet pipe 11 are connected to the both ends of the lower header tank 4. The evaporator 60 includes communication holes 61, 62, and 63. The communication hole 61 is formed in the divide plate 13 in the upper header tank 3. The communication hole 61 allows neighboring second header chamber 15 and third header chamber 16 to communicate with each other. The communication hole 62 extends through the upper ends of the flat tubes 6 of the third pass P3, the fourth pass P4, the fifth pass P5, and the sixth pass P6. The communication hole 63 is formed in the divide plate 18 in the lower header tank 4. The communication hole 63 allows the neighboring second header chamber 20 and third header chamber 21 to communicate with each other, the chambers 20 and 21 being different from the fourth header chamber 23 connected to the outlet pipe 11. The communication holes 61, 62, and 63 achieve the identical benefits.

Fourth Embodiment

Figure 11:
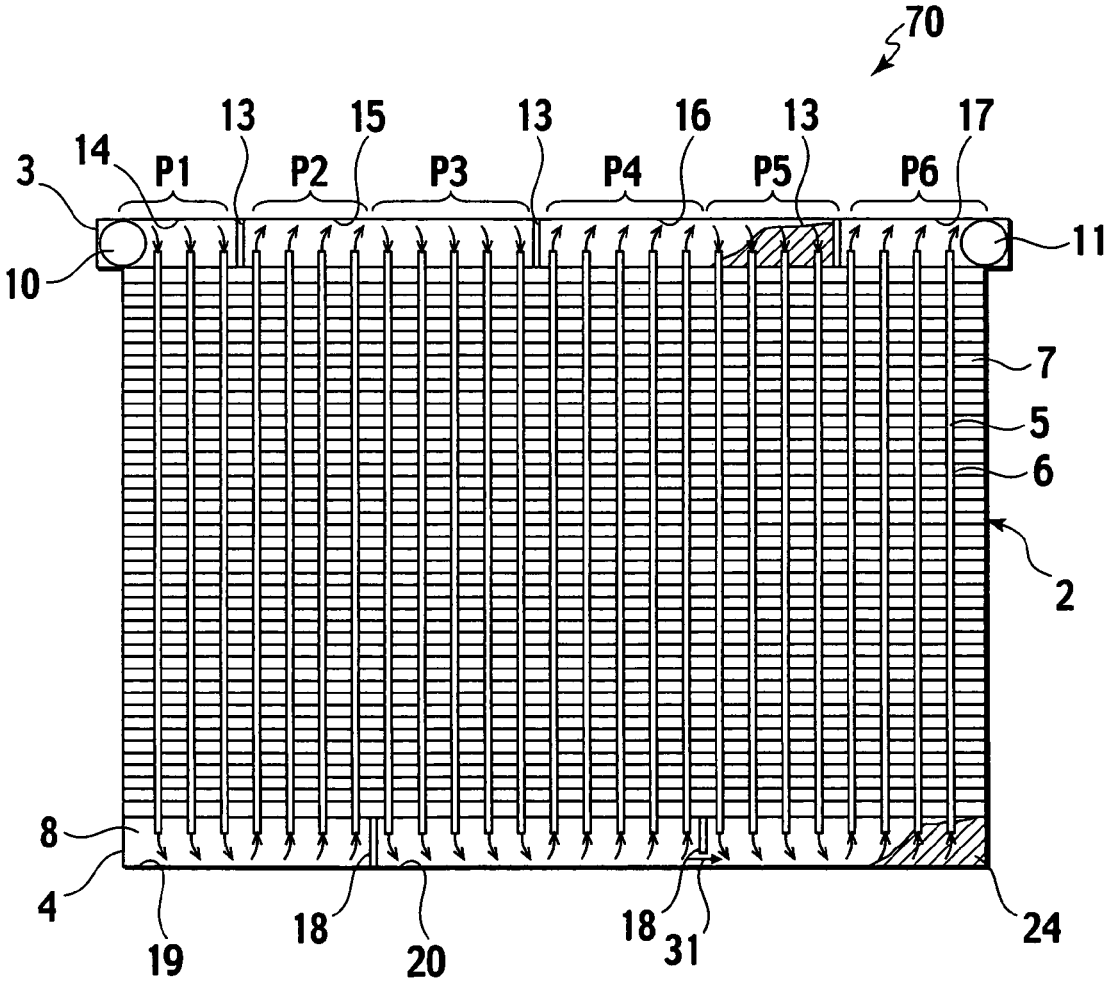
FIG. 11 is a vertical sectional view illustrating relevant parts of an evaporator for a carbon dioxide air-conditioner according to a fourth embodiment.

With reference to FIG. 11, an evaporator 70 is characterized in that an area of a refrigerant passage of each of the sixth pass P6 and the fifth pass P5 on the side of the refrigerant outlet is set smaller than an area of the refrigerant passage of the fourth pass P4 as compared with the first embodiment illustrated in FIGS. 1 to 3. Each of the sixth pass P6 and the fifth pass P5 has four flat tubes 6. The fourth pass P4 has five flat tubes 6.

In this embodiment, the area of the refrigerant passage of each of the sixth pass P6 and the fifth pass P5 on the side of the refrigerant outlet is smaller than the area of the refrigerant passage of the fourth pass P4. This structure increases the speed of a refrigerant that passes through the sixth pass P6 and the fifth pass P5 on the side of the refrigerant outlet.

Like the first embodiment illustrated in FIGS. 1 to 3, this embodiment prevents the lubricant oil 24 separated from the refrigerant from accumulating in the lower header tank 4 that is not connected to the inlet pipe 10 and the outlet pipe 11. The refrigerant passes through the sixth pass P6 and the fifth pass P5 on the side of the refrigerant outlet at a fast speed. These flows make it difficult to form an oil film of the oil 24 on the wall surface of the refrigerant passage 5 in the flat tube 6 on the side of the refrigerant outlet, which achieves a higher heat transfer, thus enhancing the heat exchange performance.

Fifth Embodiment

Figure 12:
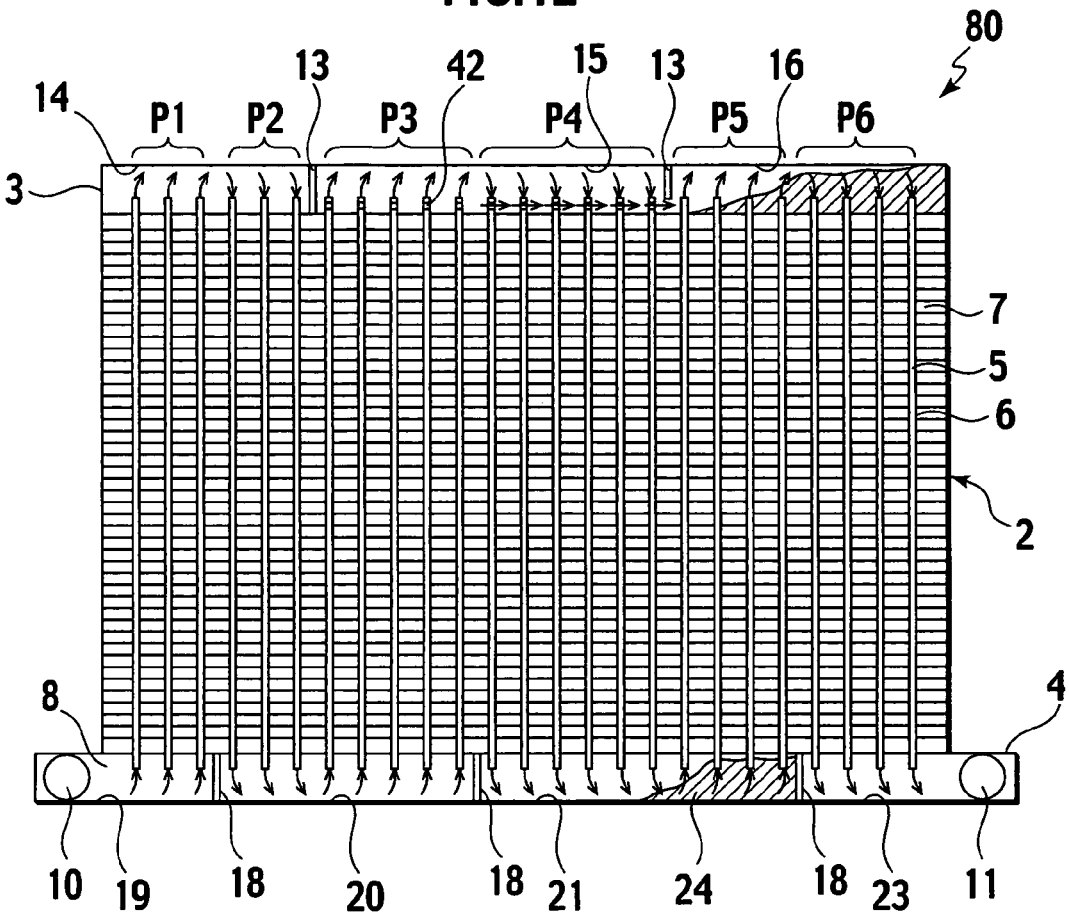
FIG. 12 is a vertical sectional view of a modification of the embodiment illustrated in FIG. 11.
Figure 13:
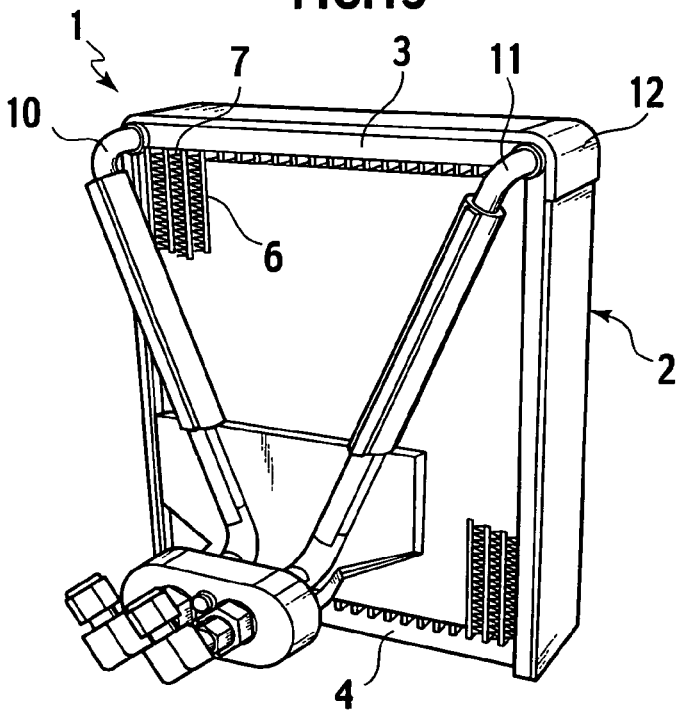
FIG. 13 is a perspective view illustrating one example of an evaporator for a carbon dioxide air-conditioner.

An evaporator 80 illustrated in FIG. 12 is characterized in that an area of a refrigerant passage of each of the sixth pass P6 and the fifth pass P5 on the side of the refrigerant outlet is set smaller than an area of the refrigerant passage of the fourth pass P4 as compared with the second embodiment illustrated in FIGS. 4 to 6. Each of the sixth pass P6 and the fifth pass P5 has four flat tubes 6. The fourth pass P4 has six flat tubes 6.

In this embodiment, the area of the refrigerant passage of each of the sixth pass P6 and the fifth pass P5 on the side of the refrigerant outlet is smaller than the area of the refrigerant passage of the fourth pass P4. This structure increases the speed of a refrigerant that passes through the sixth pass P6 and the fifth pass P5 on the side of the refrigerant outlet.

Like the second embodiment illustrated in FIGS. 4 to 6, this embodiment prevents the lubricant oil 24 separated from the refrigerant from accumulating in the upper header tank 3 that is not connected to the inlet pipe 10 and the outlet pipe 11. The refrigerant passes through the sixth pass P6 and the fifth pass P5 on the side of the refrigerant outlet at a faster speed. These flows make it difficult to form an oil film of the oil 24 on the wall surface of the refrigerant passage 5 in the flat tube 6 on the side of the refrigerant outlet, which achieves higher heat transfer, thus enhancing the heat exchange performance.

In the fourth and the fifth embodiments, the total number of the first pass P1 to the sixth pass P6 is six. The total number of passes may be an arbitrary number N, which achieves the identical benefits. That is, an area the refrigerant passage of a pass (N-th pass) on the side of the refrigerant outlet, and an area of a refrigerant passage of a pass (N-1-th pass) that is located on an upstream side by one from the former pass on the side of the refrigerant outlet may be set smaller than an area of a refrigerant passage of a pass (N-2-th pass) that is located on an upstream side by two from the former pass on the side of the refrigerant outlet. This structure achieves the identical benefits.

The fourth and the fifth embodiments exemplify a structure that the number of flat tubes 6 of the sixth pass P6 and the fifth pass P5 is smaller than the number of the flat tubes 6 of the fourth pass P4. This invention is not limited to this structure. The inner diameters of the refrigerant passages 5 of the flat tubes 6 of the sixth pass P6 and the fifth pass P5 on the refrigerant outlet side may be reduced. With this structure, an area of the refrigerant passage of each of the sixth pass P6 and the fifth pass P5 are made smaller than an area of the refrigerant passage of the fourth pass P4, which achieves the identical benefits.

As described in each of the embodiments, the frequency of oil accumulation in an intermediate header chamber is reduced. The oil 24 accumulated in a header chamber just in front of the sixth pass P6 is taken out from the outlet pipe together with the refrigerant. With this structure, more oil is returned to the compressor from the evaporator.

Although the invention has been described above by reference to certain embodiments of the invention, the invention is not limited to the embodiments described above. Modifications and variations of the embodiments described above will occur to those skilled in the art, in light of the above teachings. The scope of the invention is defined with reference to the following claims.

An evaporator includes a header having first and second chambers having a carbon dioxide refrigerant to flow therebetween for heat-exchange. The evaporator includes a partition separating the first and second chambers from each other, defining a hole communicating with the first and second chambers. The hole is positioned at the vertically lower of the partition.

What is claimed is:

1. An evaporator for a carbon dioxide air-conditioner comprising:

a core comprising: heat-exchange tubes and radiation fins alternately stacked on each other, the heat-exchange tubes defining refrigerant passages;

a header tank connected to the heat-exchange tubes; and a partition separating the header tank into first and second header chambers to turn a refrigerant, wherein the partition defines a communication hole allowing the first and second header chambers to communicate with each other, wherein the heat-exchange tubes have ends projecting into the header tank, and wherein at least one of the ends has a communication portion which is an opening extending through the side of the tube along a longitudinal direction of the header tank.

2. The evaporator according to claim 1, wherein the header tank connects to an outlet pipe having the refrigerant to flow out therefrom, wherein the first and second header chambers are separate from a header chamber connected to the outlet pipe.

3. The evaporator according to claim 1, wherein the communication hole is positioned at the vertically lowermost portion of the partition.

4. The evaporator according to claim 1, wherein the heat-exchange tubes are divided into a set of refrigerant circulation passes, wherein the set of refrigerant circulation passes has a first pass on a refrigerant output side, a second pass upstream by one from the first pass, and a third pass upstream by two from the first pass, wherein each of the first pass and the second pass is set smaller in refrigerant passage area than the third pass.

5. An evaporator comprising:

a core comprising: substantially vertically extending heat-exchange tubes and radiation fins alternately stacked on each other, each heat-exchange tube defining refrigerant passages therein and formed with an upper end opening at an upper end and an lower end opening at a lower end;

a substantially horizontally extending upper header tank connected to the upper end openings of the heat-exchange tubes, the upper ends of the heat-exchange tubes disposed into the header tank;

a substantially horizontally extending lower header tank connected to the lower end openings of the heat-exchange tubes;

a partition separating at least one of the header tanks onto chambers and formed with a communication hole allowing the chambers to communicate with each other; and a communication portion which is an opening formed at one of the upper ends of the heat-exchange tubes and extending through the side thereof along a longitudinal direction of the header tank.

* * * * *